US005305000A

United States Patent [19]

Harris

[11] Patent Number: 5,305,000

[45] Date of Patent: Apr. 19, 1994

[54] LOW LOSS ELECTROMAGNETIC ENERGY PROBE

[75] Inventor: James M. Harris, Terrell, Tex.

[73] Assignee: Gardiner Communications Corporation, Garland, Tex.

[21] Appl. No.: 867,298

[22] Filed: Apr. 13, 1992

Related U.S. Application Data

[63] Continuation of Ser. No. 563,430, Aug. 6, 1990, abandoned.

[51] Int. Cl.[5] ..... H01Q 13/080; H01Q 1/400; H01P 5/103

[52] U.S. Cl. ..... 343/786; 333/26

[58] Field of Search ..... 333/26, 33; 343/786, 343/860, 873, 904-906; H01Q 13/00-13/08, 1/40

[56] References Cited

U.S. PATENT DOCUMENTS

| | | | |
|---|---|---|---|
| 2,825,060 | 2/1958 | Ruze | 343/786 |
| 3,478,282 | 11/1969 | Smith | 333/26 |
| 4,349,790 | 9/1982 | Landry | 333/26 |
| 4,740,764 | 4/1988 | Gerlack | 333/26 |
| 4,901,369 | 2/1990 | Momose et al. | 343/872 |
| 4,970,477 | 11/1990 | Gurcan et al. | 333/26 |

FOREIGN PATENT DOCUMENTS

| | | | |
|---|---|---|---|
| 0096901 | 5/1985 | Japan | 333/26 |

OTHER PUBLICATIONS

Beaudette et al., Waveguide-to-Microstrip Transitions, Microwave Journal, Sep. 1989, pp. 211-216.

*Primary Examiner*—Rolf Hille
*Assistant Examiner*—Peter Toby Brown
*Attorney, Agent, or Firm*—Hubbard, Tucker & Harris

[57] ABSTRACT

A low noise block feedhorn system includes a waveguide antenna for receiving RF signals. The transition element is a waveguide to coaxial line probe assembly which includes a high conductivity probe and a low loss dielectric sleeve. The dielectric sleeve has a ring spacer at its top and probe spacer at the bottom to provide an air gap between the dielectric sleeve and the probe. The dielectric sleeve concentrates the RF field next to the probe and the air gap reduces the field intensity of the probe surface. Thus, a proper impedance match between the waveguide and the probe with less conducting losses is provided. A low noise block downconverter has its preamplifier connected by its input impedance matching network to the coaxial cable. By replacing the coaxial cable with a coaxial transformer as a second transition element the network can be eliminated and the preamplifier connected directly to the coaxial transformer for a further improvement in loss.

5 Claims, 2 Drawing Sheets

LOW LOSS ELECTROMAGNETIC ENERGY PROBE

This application is a continuation of application Ser. No. 07/563,430, filed Aug. 6, 1990, now abandoned.

This invention relates to the invention of U.S. patent application Ser. No. 278,589, filed Dec. 1, 1988, now U.S. Pat. No. 5,005,023 for "Dual Band Integrated Low Noise Block Feedhorn System."

BACKGROUND OF THE INVENTION

This invention relates to communication microwave devices having high frequency electromagnetic energy waveguides connected to low noise amplifiers and more particularly to an improved low noise block feedhorn system including a low loss electromagnetic energy matching probe for coupling electromagnetic energy received by a waveguide type feedhorn to a low noise amplifier for signal processing.

In the past, low noise block feedhorn systems have included feedhorns to receive microwave energy. A section of waveguide has been used as the feedhorn. The waveguide is a metal pipe having a predetermined cross section usually rectangular or circular specifically designed to guide or conduct high frequency electromagnetic waves through its interior. The waveguide has a metal rod that projects into, but is insulated from the waveguide for coupling the received waves to an external circuit for signal processing. This metal rod is known as a "probe".

Thick probes, capped probes, and dielectric loaded probes or combinations of these probes have been used for matching the waveguide to the probe. Matching is connecting two circuits or parts together in such a way that their impedances (opposition to current flow) are equal or are equalized by a coupling device, so as to give maximum transfer of energy. To obtain maximum power transfer from the waveguide to the probe, a significant portion of electromagnetic energy must be in the vicinity of the probe. The thick probes, capped probes, and dielectric loaded probes are effective means for increasing the electromagnetic waves (RF power) surrounding the probe. A problem attends their use; the tangential components of the magnetic field around the probes induce energy (RF currents) on the probe, which cause conducting losses in the probe.

Further, in the use of thick probes and capped probes, the RF currents also increase with increase in the conducting probe's surface areas. The larger the conducting probe surface areas, the higher the conducting probe losses. To decrease the surface area, the dielectric coated probe was developed. However, the dielectric coating increases the concentration of the RF energy field surrounding the probe; the result is also higher conduction losses in the probe.

Higher conducting losses on the probe represent higher noise temperature in a satellite communication system. The noise temperature is the temperature at which the thermal noise power of a passive system per unit bandwidth is equal to the noise at the actual terminals. Noise is an undesired electric disturbance that tends to interfere with normal reception or processing of a desired signal. For example, it produces the small black or white spots over the entire image area of a television set.

Further, in known communication devices, after transitioning (passing microwave energy from one medium to another, e.g. air or vacuum into the inner metal conductor of a coaxial cable) from the waveguide's probe to a coaxial transmission line, a second transition between the coaxial line and a microstrip amplifier circuit (active element) has also been required. The input matching network between the probe and the microstrip amplifier circuit (the first field effect transistor (FET)) is the dominant passive loss contributor to the amplifier circuit.

SUMMARY OF THE INVENTION

Accordingly, it is an object of the present invention to provide an improved low noise block feedhorn system.

Another object of the present invention is to improve the transition energy from an electromagnetic energy waveguide to coaxial cable.

Still another object of the invention is to reduce conducting losses substantially in a microwave waveguide probe.

Yet another object of the invention is to reduce substantially the noise temperature found in communication satellite systems.

A further object of the invention is to reduce substantially the conductive loss between passive and active elements in a communication satellite system.

Briefly stated, the improved low noise block feedhorn system has a waveguide type feedhorn for receiving electromagnetic waves. An air dielectric probe is mounted in the waveguide, and a coaxial cable has its inner conductor connected to an end of the probe. The air dielectric probe transitions the incoming electromagnetic waves to the coaxial cable. A low noise block has a preamplifier to amplify the incoming signals to a working level. The preamplifier is connected to a second transitioning means for matching the impedances of the coaxial cable and the preamplifier. The transitioning means is either a microstrip network or a modification (enlargement) of the inner conductor of the coaxial cable.

BRIEF DESCRIPTION OF THE DRAWINGS

Other objects and features of the invention will become more readily apparent from the following detailed description when read in conjunction with the accompanying drawings, in which.

DETAILED DESCRIPTION OF THE PREFERRED EMBODIMENT

Figure 1:
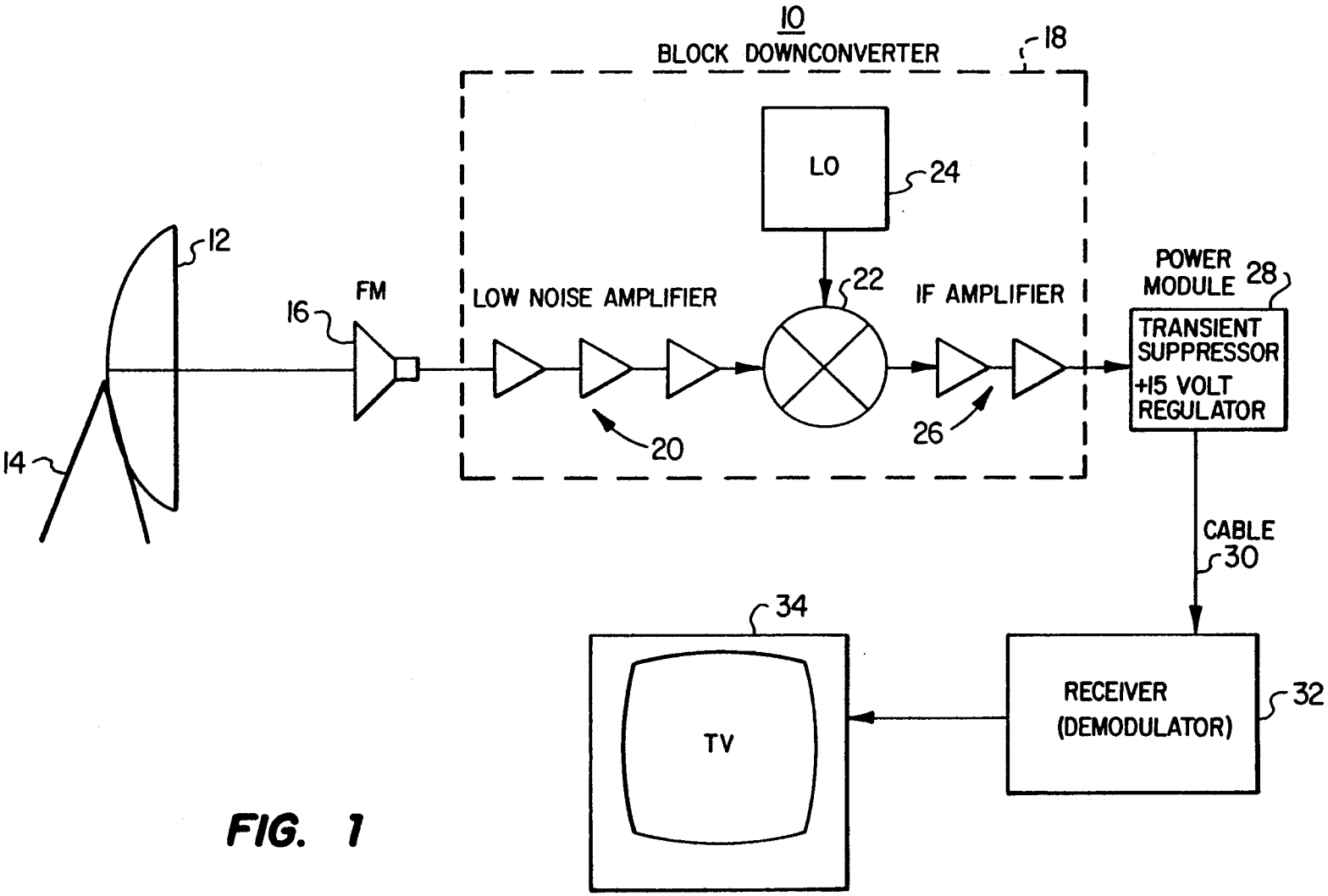
FIG. 1 is a block diagram of a satellite communication receiver system.
Figure 3:
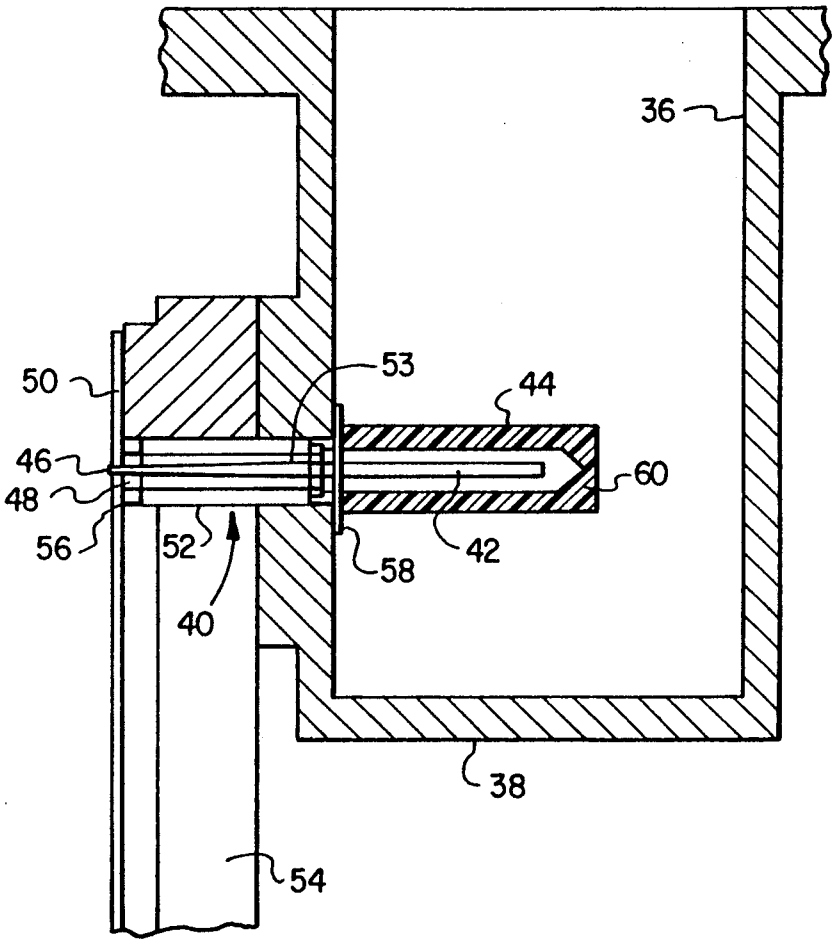
FIG. 3 is an alternate embodiment of the low noise block feedhorn system as shown in FIG. 2 that is partly in section.
Figure 2:
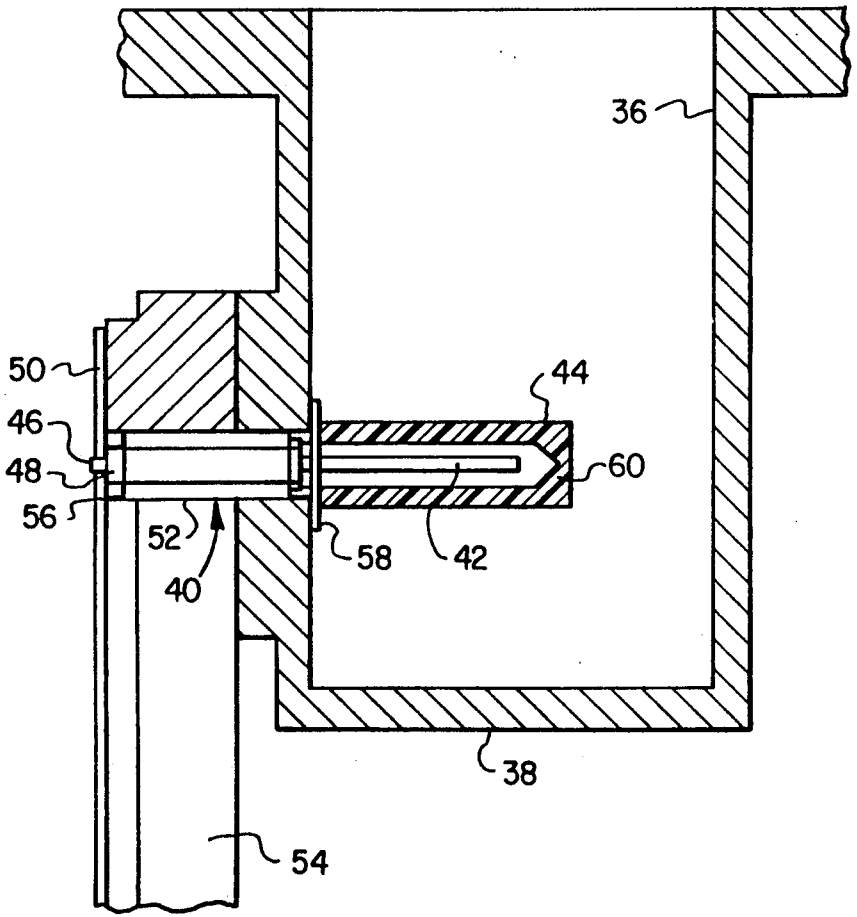
FIG. 2 is a partial view of the low noise block feedhorn system partly in section to show the air dielectric probe arrangement in accordance with the subject matter of the invention.

Referring now to FIGS. 1 and 2, a description of the preferred embodiment of the present invention is given.

The earth station 10 of a communication satellite system includes a parabolic reflector (dish) 12 mounted upon a support 14 for illumination by a communications satellite transmitting modulated RF signals at, for example, C-band frequency. A feedhorn 16 is mounted at the focal point of the dish for receiving the reflected energy for a block downconverter 18 for the C-band frequency.

The block downconverter is, for example, a Gardiner Communications Corporation 200-9545-001 device. The device includes a three-stage low noise amplifier 20 for amplifying the incoming signals to a working level, the system having a transitioning means 19 for matching the impedances of a coaxial cable 52 to the amplifier. A mixer 22 is connected to the low noise amplifier and local oscillator 24 for combining the incoming modulated RF signal with the signal of the local RF oscillator to produce a modulated intermediate frequency (IF) signal. And a two stage IF amplifier 26 amplifies the IF signals to a second working level.

A power module 28 is connected to the output of the block downconverter 18. The power module includes a transient suppressor and a +15 volt regulator connected by a coaxial cable 30 to a receiver (demodulator) 32. The power module passes the modulated IF signals to the demodulator and receives dc power through the inner conductor of the coaxial cable 30 for the block downconverter. As the demodulator may be at any distance from the power module, the dc voltage may be for a maximum distance between the demodulator and power module (about 500 feet); thus, the power module regulates the dc power received and suppresses any transient voltage received to protect the block downconverter from destructive voltages and heat generated by power modules. A suitable demodulator is a Satellite Technology Services receiver model SR 100.

A television set 34 is connected to the demodulator 32 for receiving TV channel 3 or 4 signals for processing.

Referring now to FIG. 2, a preferred embodiment of the low noise block feedhorn system including the low loss electromagnetic energy probe of the present invention is shown. The feedhorn 16 includes a waveguide 36. The waveguide may be, for example, either a rectangular waveguide or circular waveguide. For purposes of description only and not by way of limitation the rectangular waveguide will be used. The waveguide 36 has a closed end 38.

A probe assembly 40 is attached to the waveguide 36 adjacent to the end 38, i.e. preferably ¼ wavelength from the end. The probe assembly 40 includes a high conductivity probe 42 and a low loss dielectric sleeve 44. The probe has one end connected to a first end of an inner conductor 46 of a coaxial cable 48. A second end of the inner conductor of the coaxial cable is connected to the printed circuit board 50 of the block downconverter 18 as will be described hereinafter. The outer conductor of the coaxial cable 48 surrounds the inner conductor and extends from the printed circuit board 50 of the block downconverter 18 through a passageway 52 formed in a carrier member 54 and adjacent wall of the waveguide 36 to the point adjacent to where the probe connects to the inner conductor of the coaxial cable. The carrier member supports the printed circuit board 50 of the block downconverter 18 and the feedhorn 16.

The dielectric sleeve 44 is mounted in the passageway 52 and includes a top ring spacer 56 for holding the coaxial cable 48 in a space relationship with respect to the passageway 52, and a probe spacer 58 for centering the probe within a body portion of the sleeve. The sleeve 44 has a closed end 60 adjacent to the end of the probe. In this manner, an air gap is provided between the dielectric sleeve and the conducting probe. The air gap, when properly dimensioned, reduces the field intensity on the probe surface thus reducing the loss.

To ensure proper impedance match between the waveguide 36 and the probe 42, the probe assembly 40 requires certain probe dimensions, gap width, sleeve dimensions and dielectric constant. The proper dimensions and selection of the dielectric constant of the probe assembly are empirically determined for each design. For example, in connection with a probe for C-band, the following dimensions (inches) beginning with the end of the inner conductor of the coaxial cable as 000 were determined to be as follows:

0.045 to the upper surface of the carrier plate housing, 0.405 to the lower surface of the carrier plate housing and beginning of the waveguide, 0.553 to the top of the probe spacer, 0.588 to the bottom of the probe spacer, 0.618 to the bottom of the waveguide, 0.638 to the bottom of the sleeve stop, 1.220 to the end of the probe, 1.324 to the tapered end of the sleeve bore, 1.359 to the end of the sleeve, 1.763 to the opposing inner surface of the waveguide, and 1.863 to the outer surface of the waveguide.

The coaxial cable is a low noise cable having an outside diameter of 0.101 inches.

The probe diameter is 0.050 inches.

The sleeve diameters are 0.130 inches interior and 0.250 inches exterior.

The low loss dielectric sleeve material is a polystyrene plastic sold under the trademark REXOLITE 1422 by C-LEC, Inc. which has a dielectric constant of 2.45–2.650 and a dissipation factor of 0.0001–0.0003 (ASTM D150, 1 MHz).

In operation, the dielectric sleeve concentrates the RF power around the probe. The proper dimensions and selection of the dielectric constant of the probe assembly ensures that the RF field surrounding the probe is optimally matched to the coaxial line. The air gap between the dielectric sleeve and the probe reduces the field intensity on the probe surface thus reducing the loss. Also, the dielectric sleeve causes sufficient RF field to be concentrated in the general probe region similar to the conventional dielectric loaded probe. Thus, the low loss dielectric probe assembly allows for a proper impedance match between the waveguide and the probe with substantially reduced conducting losses. The result is a decrease in the effective system noise temperature.

A further reduction in circuit loss can be obtained by using a coaxial transformer to implement the low noise amplifier's input matching network in the coaxial transmission line. This implementation includes tapering empirically the diameter of the inner conductor 53 of the coaxial cable. In this implementation, the first amplifier is connected directly to the inner conductor of the coaxial cable.

An improvement in system noise performance of five degrees or more can be achieved by eliminating the microstrip input matching network.

Although only a single embodiment of the invention has been described, it will be appreciated by those persons skilled in the art that various modifications to the details of construction shown and described may be made without departing from the scope of this invention.

What is claimed is:

1. A waveguide coupler comprising:

a waveguide having a closed end and an aperture spaced from the closed end;

a transmission line;

a probe assembly connected to the transmission line and mounted in the aperture of the waveguide comprising a probe, a low-loss dielectric sleeve, and a probe spacer for centering the probe within the dielectric sleeve, the dielectric sleeve surrounding but not contacting the probe and providing an air gap between the probe and the dielectric sleeve along the length of the probe thus reducing electrical losses for the coupler, wherein the transmission line is a coaxial transmission line comprising an inner conductor and an outer conductor, the inner conductor having two ends, the first end of the inner conductor electrically connected to one end of the probe and the second end electrically connected to a low-noise amplifier and the outer conductor surrounding the inner conductor and electrically connected to and extending from a printed circuit board on which the low noise amplifier is mounted to an inner wall of the waveguide without touching the waveguide.

2. The waveguide coupler of claim 1, wherein the waveguide is connected to a feedhorn for receiving electromagnetic energy.

3. The waveguide coupler of claim 1, wherein the probe is a high conductivity probe.

4. The waveguide coupler of claim 1, wherein the probe diameter is minimized for a predetermined intended frequency of operation so as to reduce the surface area of the probe.

5. The waveguide coupler of claim 1 wherein the inner conductor tapers from said first end to said second end.

* * * * *